United States Patent [19]

Reeves, Jr. et al.

[11] Patent Number: 4,494,583

[45] Date of Patent: Jan. 22, 1985

[54] BUNG ALIGNMENT APPARATUS

[75] Inventors: Robert H. Reeves, Jr., Angleton; Don G. Chandler, Lake Jackson; H. A. Jorgensen, Freeport, all of Tex.

[73] Assignee: Velasco Scale Company, Freeport, Tex.

[21] Appl. No.: 494,579

[22] Filed: May 16, 1983

[51] Int. Cl.[3] ..... B65B 3/28

[52] U.S. Cl. ..... 141/83; 141/94; 141/168; 141/270; 141/181

[58] Field of Search ..... 141/129-191, 141/128, 94, 95, 83, 37-66, 250-284, 285-310, 375, 87, 90, 93

[56] References Cited

U.S. PATENT DOCUMENTS

| | | | |
|---|---|---|---|
| 3,610,398 | 10/1971 | Rice | 141/168 |
| 4,211,263 | 7/1980 | Kennedy et al. | 141/128 |
| 4,337,802 | 7/1982 | Kennedy et al. | 141/83 |

*Primary Examiner*—Houston S. Bell, Jr.

*Attorney, Agent, or Firm*—Arnold, White & Durkee

[57] ABSTRACT

An improved bung alignment mechanism for liquid filling apparatus is characterized by an infrared sensor which aligns the vertical axis of the filling lance and bung. The apparatus includes a wheeled carriage which moves along a stanchion, the carriage being operatively associated with the filling lance. A wiper ring assembly, a drip collection assembly, and a fume disposal assembly which contains or entraps substantially all sources of fume generation are also provided as part of the filler apparatus.

21 Claims, 3 Drawing Figures

BUNG ALIGNMENT APPARATUS

This invention relates to bung alignment apparatus used in conjunction with apparatus for dispensing predetermined amounts of liquid by weight into a container and, in particular, is directed toward an improved apparatus for dispensing liquid into a container of the type shown in commonly-assigned U.S. Pat. Nos. 4,211,263 and 4,337,802, said patents are hereby incorporated by reference.

In most apparatus adapted for the filling of liquids into containers, the containers to be filled are conveyed by a suitable roller conveyor or like apparatus past a number of stations at which specific functions related to the filling of the container occur. For example, the empty containers are usually introduced singly onto the conveyor and may be carried past a first station where the liquid-receiving opening of each container is aligned or oriented into a predetermined position. The containers might also be oriented at the filling station. At the filling station, a predetermined quantity of liquid is introduced into the container. The alignment methods of prior art devices have typically involved operated assisted manual alignment or various timing mechanisms. All of these methods suffer from inherent deficiencies which are addressed and solved by the alignment apparatus of this invention.

Depending upon the nature of the liquid, any of several filling techniques may be utilized to dispense a predetermined metered amount of liquid into the container. If the liquid is susceptible to foaming, it is typically the practice to insert a filling lance (the conduit through which the liquid passes into the container) into the container such that the lower discharge end of the lance is in close proximity to the bottom of the container.

The movement of the filling lance, sometimes referred to as a conduit, is normally initiated by the operator of the filling apparatus. A predetermined small amount of liquid is then slowly introduced into the container until the level of liquid in the container rises above the discharge end of the lance. Since the discharge of the lance is thereafter below the level of liquid in the container, most of the remaining weight of the liquid may be introduced into the container at a relatively faster fill rate until the fill rate is slowed down (to a dribble fill rate) just before the final weight of liquid has been dispensed. During the fast fill operation, the lance is normally withdrawn from the container but at a rate which maintains the end of the lance below the liquid surface in the container. The withdrawal of the lance is generally controlled by the operator in order to maintain the discharge end of the lance subsurface.

Once the predetermined amount of liquid has been introduced into the container, the lance is fully withdrawn. As noted, for subsurface fill operations, a problem has existed in that the operators of liquid filling apparatus have had to control the withdrawal of the lance during the fill, keeping the lance subsurface to avoid foaming and the like and yet sufficiently withdrawn that the accuracy of the weight of liquid introduced was not significantly influenced by the weight of liquid within the lance. Further concern existed for the operators when working with toxic or noxious liquids, as it was desired to keep a minimum of the outside surface area of the lance from contamination by submergence in the liquid. As disclosed in the incorporated reference, U.S. Pat. No. 4,211,263, a wiper ring may be utilized about the lance to help alleviate this latter problem. In addition to the strain placed on operators to carefully monitor and control the lance withdrawal, it is believed that some inaccuracy in the final fill weight tends to occur because operators will withdraw the lance slower than necessary to avoid breaking the surface of the liquid.

Upon completion of the fill, the container will normally be conveyed along the line to another station where the container is capped.

It is believed advantageous to provide a liquid filling device that automatically controls the movement of the filling lance at the various stages in the filling process and, in particular, the withdrawal of the lance during a subsurface fill operation. It is also believed to be advantageous to provide a means for controlling fumes and excess material in a safe and efficient manner. It is further believed to be advantageous to provide a liquid filling apparatus which is of relatively simple construction and comprised of components easily maintained and operated, such an arrangement enhancing the safety and control of filling apparatus used with hazardous liquids.

A significant problem commonly encountered by container filling apparatus has been the proper alignment of the bung (a common expression for the opening into a drum or barrel) and the lance. Prior art filling devices have typically used various manual or mechanical means, all of which suffer from inherent deficiencies. One such prior art device marketed by National Controls, Inc. requires a timing device to be tripped to properly align the bung with the lance. Other prior art devices have required operator assistance to visually inspect and align the bung as well as a variety of pneumatic and hydraulic devices.

Therefore it is an object of this invention to provide an improved bung alignment apparatus which enables the user to eliminate various timing devices and mechanical means which are available in the prior art.

It is a further object of the present invention to provide a bung alignment apparatus which is adaptable to various sizes and shapes of containers without requiring a resetting of timing sequences or the like.

It is a still further object of the apparatus of this invention to provide alignment means which require very little clamping force to be placed on the drum.

The timing devices of the prior art have generally required the user to turn the container at exactly the same speed each time the container was rotated. Any change in the speed of container rotation or in the size of the container would disrupt the timing sequence and result in the lance contacting the top of the container instead of the bung. Other problems associated with timing devices involved calculation of slippage from the turning means, changes in air pressure and even minor variations in the timing apparatus itself. All of these problems have contributed to what is generally felt to be a significant problem. All of these deficiencies are addressed by the improved bung alignment device of this invention.

SUMMARY OF THE INVENTION

The above-noted and other drawbacks of the prior art are overcome, and the advantages stated above are achieved by providing a bung alignment apparatus which automatically aligns the vertical axis of the bung and the lance.

According to one aspect of the invention, the liquid filling apparatus is of a particularly simple and durable construction for increased dependability and efficiency in liquid filling operations and includes a movable conduit having an emission end for the passing of a liquid into a container and a first signal generator or start mechanism for actuating the movement of the conduit from a raised position out of the container to a lowered position in which the emission end of the conduit is disposed just above the bottom of the container. A control valve which is operable to pass liquid at a dribble or fast-fill rate is interposed between a liquid source and the conduit. A second signal generator is included, which generates a signal to actuate the dribble filling of the liquid when the emission end of the conduit reaches a position just above the bottom of the container and to actuate a delay mechanism, which, in turn, triggers the fast-fill of liquid into the container after a predetermined interval when the emission end of the conduit has been submerged in liquid. Also included is a weight responsive device, such as a scale, which is adapted to generate first and second control signals when the weight of liquid within the container reaches a first and second cut-off weight, respectively. The first control signal initiates the upward movement of the conduit, terminates the fast-filling of the liquid into the container and triggers a dribble fill rate of liquid. Finally, a third signal generator operates to produce a signal to stop the conduit at a predetermined position substantially withdrawn from the container but with the emission end of the conduit still submerged in the liquid in the container. The second control signal actuates the termination of the dribble filling of the liquid and actuates movement of the conduit back to its raised position.

In a preferred embodiment, the liquid filling apparatus of this invention includes a base having a stanchion extending upwardly and a carriage mounted for movement along the stanchion. A filler lance having an emission end is mounted for movement with the carriage. The control valve, with its actuator, is mounted to the carriage and communicates between a liquid source and the filling lance. The carriage includes a trip mechanism for actuating the second signal generator, and the third signal generator as it moves from its raised position to its lowered position to its intermediate position and back to its raised position along the stanchion. An arm assembly extends outwardly from the stanchion over a container to be filled and is positioned such that the filler lance extends through the outer end of the arm in a guided relationship therewith as the lance is moved with the carriage into and out of a container. The arm assembly includes a wiper ring apparatus for wiping liquid which is collected on the outside surface of the lance as it is withdrawn from a container; a fume disposal apparatus which entraps fumes generated by the liquid being introduced into a container and permits them to be drawn away from the area of the filling operation; and a drip collection apparatus which catches drips from the lance after the lance is withdrawn from a container.

Accordingly, it is a general object of the present invention to provide a new and improved liquid filling apparatus of particularly simple and durable construction which is effective for accurate dispensation of predetermined weights of liquid and which enhances the safe and efficient handling of toxic or noxious liquids in a filling operation.

The above and other features and advantages of the present invention will become more apparent from a detailed description of a preferred embodiment when read in conjunction with the drawings.

DETAILED DESCRIPTION OF THE INVENTION

Figure 1:
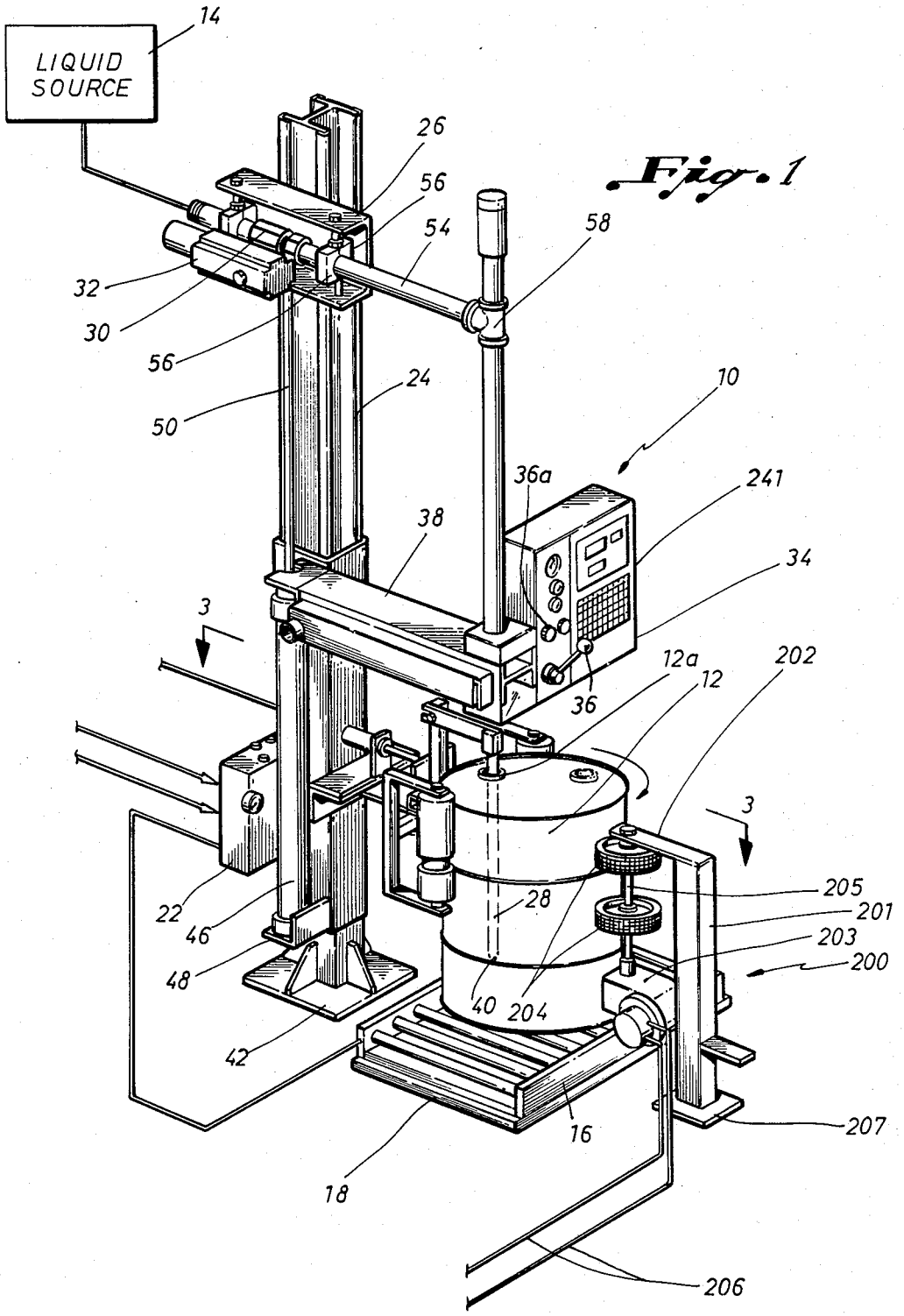
FIG. 1 is a perspective view of a liquid filling apparatus in accordance with this invention as disposed before a container base or conveying line and with the lance in the retracted position although the lance is also shown as it would appear in the filling position by dotted lines.

Throughout the following detailed description, similar reference numerals refer to similar elements in all Figures of the drawings.

Referring first to FIG. 1, there is shown a liquid filling apparatus generally indicated by reference numeral 10 in accordance with the present invention. A container 12, which is to be filled with a liquid product from a source or reservoir 14, may be conveyed by manual or mechanical means from a receiving or storage area to the filling apparatus 10. Such a container receives a predetermined weight of liquid product from the filling apparatus. The container may then be moved to a discharge area.

More specifically, a container 12 is moved into position before the filling apparatus on a base area 16 adjacent to the filling apparatus. The base 16 may, for example, be a portion of a conveyor system. Disposed beneath the base is a scale 18 for determining when the container has been appropriately filled. This scale may consist of mechanical or electronic elements which are capable of generating control signals to a control panel 22 for the filling apparatus 10, such control signals being generated as described in the incorporated reference when the predetermined first and second cut-off weights are reached.

The filling apparatus is comprised of a stanchion 24 upon which a carriage 26 may move to cause the translation of a liquid conduit or filler lance 28 from a position above the container 12 to a position within the container. A control valve 30 and an actuator 32 as described in U.S. Pat. No. 4,211,263 are affixed to the carriage 26 and are disposed between and in communication with the source of liquid 14, which may be situated behind the filling apparatus 10, and the filler lance 28. The flow of liquid into the container 12 may be introduced at a fast or dribble fill rate pursuant to appropriate actuation of the control valve 30.

Operations of the filling apparatus 10 as herein described are pneumatically instigated, the pneumatic circuitry being housed in a control panel 22. It will be appreciated, however, that alternative means for actuating the apparatus of this invention, such as electrical signals, could be used.

A starter box 34 is mounted to the assembly arm 38 and includes a start lever 36 which is movable between "on" and "off" positions. Movement of the start lever 36 downward generates a start signal, described hereinafter, which initiates the operation of the filling apparatus 10. The pneumatic connections and fittings between the starter box 34 and the control panel 22 are not shown.

When liquids which tend to foam or which generate fumes or noxious odors are being introduced into a container, a subsurface fill technique is utilized. The conduit or lance 28 must be introduced into the container until its emission end 40 is disposed just above the bottom of the container. In accordance with the invention, the lance 28 is mounted for vertical reciprocation by the translation of the carriage 26 along the stanchion 24.

As will be appreciated hereinafter, the liquid filler apparatus of this invention may be constructed of standardized components and exhibits a design which is believed manufacturable with a low material and labor cost.

The stanchion 24, in the form of an upright structural H-beam, may be suitably affixed, as by welding or support legs, to a base plate 42 which in turn may be secured to the work surface or floor. A hydraulic or pneumatic ram 46 is supported on a bracket 48 rigidly affixed to the outside of one flange of the H-beam forming the stanchion 24.

A piston rod 50 of the ram is connected by its upper end to the carriage 26. An outstanding feature of this invention is the use of a wheeled carriage on the stanchion 24 to reciprocate the filling lance.

The forward portion of the carriage 26 is provided with a control valve 30 and actuator 32 such as described in detail in U.S. Pat. No. 4,211,263, one of the incorporated reference. These elements are secured as part of liquid inlet pipe 54 to the carriage 26 by a pair of brackets 56. The inlet pipe 54 receives liquid from a supply source 14 which may conveniently be located behind the filling apparatus. The inlet pipe 54 also communicates with the lance 28 through a T-fitting 58.

The lance 28 is provided with a valve rod which extends centrally and axially therethrough and terminates in a foot valve. The structure and operation of the lance 28 is shown more completely in U.S. Pat. No. 4,337,802 and especially FIG. 7 of that patent.

The filling apparatus 10 includes an arm assembly 38 which incorporates a lance wiper ring apparatus, a drip collection apparatus and a fume disposal apparatus, all of which are described in patents which have been incorporated herein by reference. As indicated previously, it is often necessary to deal with liquid substances which may be highly toxic or noxious, and special care must be taken to avoid any contamination or leakage occurring during or as a result of the filling operation. These features are present in this invention substantially as shown and described in previously incorporated, commonly-assigned U.S. Pat. Nos. 4,211,263 and 4,337,802.

The operation of the liquid filling apparatus of the present invention and the method for subsurface filling of a container will be explained hereinafter as would be utilized for a product being introduced into a container, which product is either subject to foaming or to giving off noxious fumes.

The container 12, which is to be filled with a predetermined weight of liquid, is first appropriately positioned beneath the emission end 40 of the lance 28. The start lever 36 is pulled down, thus initiating a sequence which results in the lowering of the carriage 26 and the lance 28 into the container 12 to a position where the emmission end 40 of the lance is just above the bottom of the container.

The dribble fill of the liquid into the container begins and continues for a preset interval of time (called prefill) to allow the level of liquid introduced into the container to rise above the emission end 40 of the lance 28. This time may be set by the operator.

Once the preset interval has passed, a signal acts to open fully the control valve 30 to permit fast fill of liquid into the container.

The fast fill condition continues until such time as the weight of the liquid in the container 12 reaches the first cut-off weight, at which time the scale 18 generates its first control signal. The first control signal may be generated when about 90% of the desired liquid weight has been achieved. This first control signal actuates a valve and ultimately ram 46. Consequently, the ram piston 50 will rise and begin to lift the carriage 26 and lance 28 from its lowered position.

When the carriage begins to rise the signal to the control valve 30 will be interrupted thus causing the shut off of the flow of liquid into the container 12.

Referring now more particularly to FIG. 1 and to the driven roller means of the bung alignment apparatus of this invention, a stanchion 201, in the form of an upright structural H-beam, may be suitably affixed, as by welding or support legs, to a baseplate 207 which in turn may be secured to the work surface or floor, as by bolting. A horizontal member 202 is mounted rigidly to the top of the stanchion 201 by suitable means, such as welding, and extends from the stanchion 201 toward the stanchion 24. Similarly, a roller drive 203 is mounted by suitable means, such as bolting, to the lower portion of stanchion 201 and extends toward the stanchion 24. The roller drive 203 is powered by suitable electrical or mechanical means such as an electric or pneumatic motor in response to control signals generated as described below and passing through lines 206.

A roller drive shaft 205 is engaged by suitable means with the roller drive 203 and extends vertically through the center of and rigidly attached to two wheels 204 and thence to a horizontal member 202. A shaft 205 is attached to the member 202 by suitable means leaving the shaft 205 free to rotate. The stanchion 201 is positioned to leave sufficient space to permit the container 12 to pass between the wheels 204 and the rotatable clamps 213 when the clamps 213 are retracted as described below (see FIG. 2). In alternate embodiments of this invention other rotating means can be used. For example, instead of rotating the drum by driven rollers it could also be convenient to rotate the base supporting the drum. Similar principles and mechanical devices could be employed.

Figure 2:
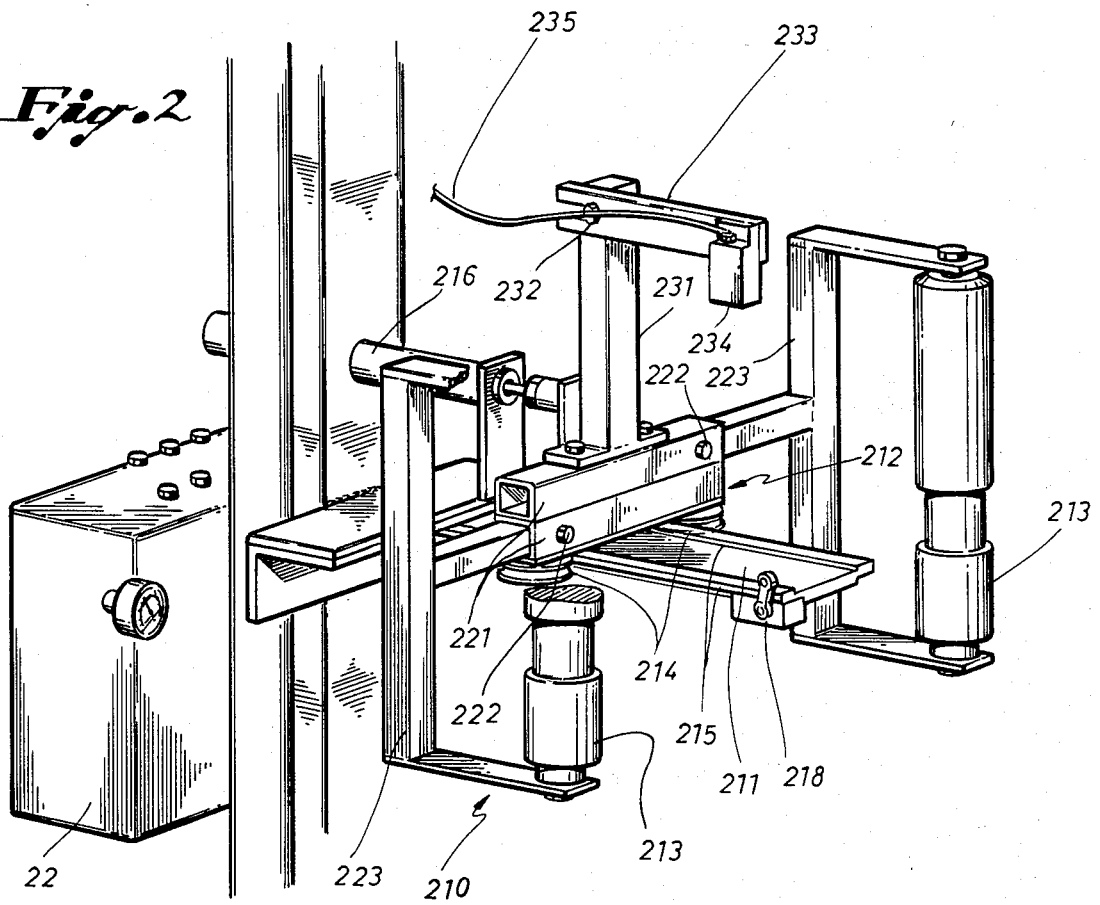
FIG. 2 is a perspective view of the roller assembly of the present invention wherein the sensing mechanism is in the retracted position.
Figure 3:
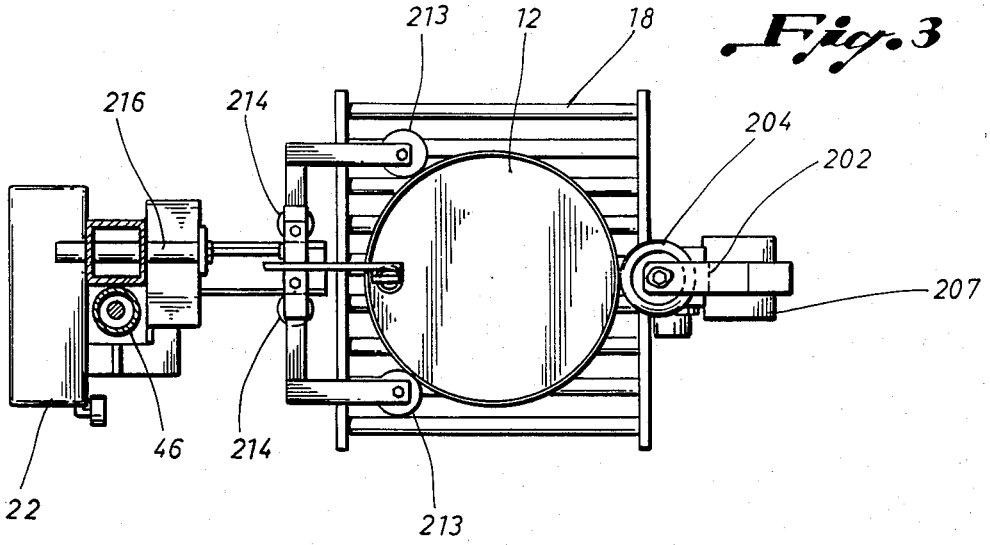
FIG. 3 is a top view of the stanchion portion of the liquid filling apparatus shown in FIG. 1.

Referring now specifically to FIG. 2 and the clamping assembly of the bung alignment apparatus of this invention, clamping assembly 210 extends horizontally from and perpendicular to stanchion 24, at a suitable height, toward the roller assembly 200. The clamping apparatus 210 comprises a horizontal member 211, joined rigidly by suitable means, such as welding, to the stanchion 24, upon which member 211 a carriage 212 may move. The carriage 212 may be formed substantially from a channel iron and includes a wheel 214 on either side of the carriage 212. The wheels 214 engage the tracks 215 on the rails or edges of the horizontal member 211.

The carriage 212 is reciprocated along horizontal member 211 by the action of a ram 216, which is driven by suitable means, such as a pneumatic motor, in response to control signals as described.

Two rigid horizontal arms 217 extend from carriage 212 perpendicular to the horizontal member 211. The arms 217 are rigidly gripped by the channel irons 221 through the action of the adjustment bolts 222. A bracket 223 is attached to the free end of each arm 217 by a suitable means, such as welding. The brackets 223 serve to hold the rotatable clamps 213 vertically in a fashion permitting the clamps 213 to rotate freely. It will be observed that the adjustment bolts 222 and the channel irons 221 permit the clamps 213 to be positioned with respect to the carriage 212 to accommodate containers of various sizes.

A vertical piece 231 is rigidly attached to the carriage 212 by suitable means, such as by welding or bolting. A horizontal arm 233 is rigidly held to the piece 231 and parallel to the horizontal member 211 by the adjustment bolt 232. The arm 233 has a slot 234 through which the adjustment bolt 232 passes.

The infrared sensor 234 is attached to the free end of the arm 233 by bolting or other suitable means not presenting the possibility of damaging the sensor 234 by heat or otherwise. The infrared device is a commercially available device. Although this preferred embodiment is described as using an infrared sensor, other commercially available, well-known sensing devices can be used. Examples of other types of devices having utility in this area are: sonic sensors, photoelectric cells, air jet sensors, mechanical sensors and/or proximity sensors. Each type of sensor has inherent advantages and disadvantages and each is commercially available.

A limit switch 218 is mounted by suitable means, such as by bolting, to the free end of the horizontal member 211. It sends a signal through a wire not shown in FIG. 2 to control panel 241 as described below.

Referring again to FIG. 1, a control panel 241 may be mounted on the liquid filling apparatus for convenience of use, e.g., on a brace attached by suitable means such as welding to the stanchion 24; care should be taken to ensure the free travel of the carriage 26. The control panel 241 additionally receives a signal from infrared sensor 234 transmitted through wire 235. The logic circuitry further transmits a power interruption signal to roller drive unit 203 via wires 206.

The container 12, which is to be filled with a predetermined weight of liquid, is first appropriately prepositioned at the filling station. The start button 36A is pushed down, causing ram 216 to urge rotatable clamps 213 against the surface of the container 12, which clamps in turn urge the far surface (opposite the stanchion 24) of the container 12 against the wheels 204. Pushing start button 36 additionally activates roller drive 203, causing the shaft 205 and thus the wheels 204 to rotate. The rotatable clamps 213 hold the container 12 against the wheels 204 as the wheels 204 rotate and additionally hold the container 12 in place, preventing lateral movement. The container 12, thus gripped, rotates in response to, and in the opposite direction from, the rotation of the wheels 203.

During rotation of the container 12, the solid material comprising the top of the container 12 passes directly beneath the infrared sensor 234, which transmits an appropriate signal via wire 235 to the control panel 241. When the container opening 12A passes beneath the sensor 234, a different signal is transmitted to the control panel 241. The logic circuitry in the control panel 241, responding to this difference, transmits a power interruption signal to the roller drive 203. The wheels 204 and therefore the container 12 cease to rotate, the bung 12A having been positioned directly beneath the sensor 234 and therefore directly beneath the emission end 40 of the lance 28. The logic circuitry in the control panel 241 then transmits a signal, thereby retracting the ram 216 and thus the roller clamps 213, and the sensor 234.

Once the automatic mode of operation has been selected any number of containers can be subsequently filled by the apparatus without further operator attendance. It will thus be appreciated that a bung alignment apparatus which results in an improved liquid filling apparatus has been described which is of simple and durable construction.

Having described the preferred embodiment of the invention, those skilled in the art may effect numerous modifications thereto in view of the foregoing description. It is, however, understood that such modifications lie within the contemplation and scope of this invention as defined in the appended claims.

What is claimed is:

1. Liquid filling apparatus for subsurface filling of containers comprising:
   (a) a conduit for introducing liquid into a container, said conduit being movable between a raised and lowered position;
   (b) a signal generator for generating a signal to initiate movement of said conduit from its raised position to its lowered position;
   (c) a weight responsive device adapted to generate a control signal when the weight of said liquid in said container equals a cut-off weight, said control signal being operable to initiate withdrawal of said conduit toward its raised position; and
   (d) a movable sensing mechanism for aligning the bung of said container with said conduit, said sensing mechanism being operated in cooperation with container rotating means.

2. The liquid filling apparatus of claim 1 wherein said sensing mechanism comprises an infrared eye.

3. The liquid filling apparatus of claim 1 wherein said sensing mechanism comprises a photoelectric cell.

4. The liquid filling apparatus of claim 1 wherein said sensing mechanism comprises a sonic sensor.

5. The liquid filling apparatus of claim 1 wherein said sensing mechanism is fixedly mounted on a retractable arm.

6. The liquid filling apparatus of claim 1 further comprising a valve to control the rate of flow of liquid through said conduit to said container.

7. The liquid filling apparatus of claim 1 further comprising a first signal generator for generating a signal to initiate movement of said conduit from its raised position to its lowered position said signal generator being actuated by said sensing mechanism.

8. The liquid filling apparatus of claim 1 further comprising a second signal generator actuable by movement of the conduit towards its lowered position, for generating a signal to actuate the valve to commence flow of liquid at a slow fill rate into such a container.

9. The liquid filling apparatus of claim 8 further comprising a delay mechanism actuable by the signal from said second signal generator to trigger a fast fill rate dispensation of liquid after a predetermined interval.

10. The liquid filling apparatus of claim 1 further comprising a weight responsive device adapted to generate a control signal when the weight of the liquid in the container equals a cut-off weight, said control signal being operable to initiate withdrawal of said conduit toward its raised position.

11. The liquid filling apparatus of claim 1 further comprising a wiper device for urging liquid adhering to the outside of the conduit toward such a container during withdrawal of said conduit.

12. The liquid filling apparatus of claim 1 further comprising a third signal generator actuable when the conduit has been raised a predetermined distance from such a container for generating a signal to stop further movement of said conduit.

13. The liquid filling apparatus of claim 1 wherein said container rotating means comprises driven roller means.

14. The liquid filling apparatus of claim 1 wherein said container rotating means comprises means for rotating the base supporting the container.

15. Liquid filling apparatus for subsurface filling of containers comprising:

(a) a conduit for introducing liquid into a container, said conduit being movable between a raised and lowered position;

(b) a valve to control the rate of flow of said liquid through said conduit to said container;

(c) first and second signal generators for initiating movement of said conduit from its raised position to its lowered position;

(d) a weight responsive device adapted to generate a control signal when the weight of said liquid in said container equals a cut-off weight, said control signal being operable to initiate withdrawal of said conduit toward its raised position; and (e) a movable, infrared sensing mechanism for aligning the bung of said container with said conduit, said sensing mechanism being fixedly mounted on a retractable support arm; said movable, infrared sensing mechanism being operated in cooperation with driven roller means for rotating said container.

16. The liquid filling apparatus of claim 15 further comprising a delay mechanism actuable by the signal from said second signal generator to trigger a fast fill rate dispensation of liquid after a predetermined interval.

17. The liquid filling apparatus of claim 15 further comprising a weight responsive device adapted to generate a control signal when the weight of the liquid in the container equals a cut-off weight, said control signal being operable to initiate withdrawal of said conduit toward its raised position.

18. The liquid filling apparatus of claim 15 further comprising a wiper device for urging liquid adhering to the outside of the conduit toward such a container during withdrawal of said conduit.

19. The liquid filling apparatus of claim 15 further comprising a third signal generator actuable when the conduit has been raised a predetermined distance from such a container for generating a signal to stop further movement of said conduit.

20. The liquid filling apparatus of claim 15 wherein said container rotating means comprises means for rotating the base supporting the container.

21. In liquid filling apparatus adapted for subsurface filling of containers, said apparatus including: a conduit for introducing liquid into a container, said conduit being movable between a raised and a lowered position; a valve to control the rate of flow of liquid through the conduit to said container; a first signal generator for generating a signal to initiate movement of the conduit from its raised position to its lowered position; a second signal generator actuable by movement of the conduit toward its lowered position, for generating a signal to actuate the valve to commence flow of liquid at a slow fill rate into said container; a delay mechanism actuable by the signal from the second signal generator to trigger a fast fill rate dispensation of liquid after a predetermined interval; a weight responsive device adapted to generate a first and a second control signal when the weight of the liquid in the container equals a first and a second cut-off weight, respectively, said first control signal being operable to initiate withdrawal of the conduit towards its raised position and to actuate the valve to return to a slow fill rate of dispensation of liquid through the conduit; a wiper device for urging liquid adhering to the outside of the conduit toward said container during withdrawal of the conduit; and a third signal generator actuable when the conduit has been raised a predetermined distance from such a container for generating a signal to stop further movement of the conduit; said second control signal, which is generated when the second cut-off weight of liquid within such a container is achieved, initiates the termination of flow of liquid from the conduit and a movement of the conduit to its raised position, the improvement which comprises:

a driven roller and two nondriven rollers, each having a vertical central axis, positioned to restrict said container's lateral motion during the rotating and filling operation, the nondriven rollers being movable between a position contiguous to the surface of the container and a retracted position permitting the container to be removed and a subsequent container to be positioned;

an infrared sensor, movable in cooperation with said nondriven rollers between (a) a functional position above the level of the top of the container and in linear alignment with the raised liquid conduit and (b) a retracted position permitting movement of the conduit;

means for retracting said nondriven rollers and said infrared sensor;

control means (a) to measure the instantaneous intensity of the infrared radiation detected by said sensor, and (b) to detect changes in such intensity taking place when the bung of the empty container passes directly beneath said sensor; and means for controlling the rotation of said container such that when said infrared sensor indicates that the bung is aligned directly beneath the conduit a signal is generated which terminates the rotational drive of the driven rollers.

* * * * *